US008299429B2

(12) United States Patent
Vertes et al.

(10) Patent No.: US 8,299,429 B2
(45) Date of Patent: Oct. 30, 2012

(54) THREE-DIMENSIONAL MOLECULAR IMAGING BY INFRARED LASER ABLATION ELECTROSPRAY IONIZATION MASS SPECTROMETRY

(75) Inventors: Akos Vertes, Reston, VA (US); Peter Nemes, Silver Spring, MD (US)

(73) Assignee: The George Washington University, Washington, DC (US)

( * ) Notice: Subject to any disclaimer, the term of this patent is extended or adjusted under 35 U.S.C. 154(b) by 0 days.

(21) Appl. No.: 13/101,518

(22) Filed: May 5, 2011

(65) Prior Publication Data

US 2011/0272572 A1 Nov. 10, 2011

Related U.S. Application Data

(63) Continuation of application No. 12/323,276, filed on Nov. 25, 2008, now Pat. No. 7,964,843, which is a continuation-in-part of application No. 12/176,324, filed on Jul. 18, 2008, now Pat. No. 8,067,730.

(60) Provisional application No. 60/951,186, filed on Jul. 20, 2007.

(51) Int. Cl.
*H01J 49/04* (2006.01)

(52) U.S. Cl. ..... 250/288; 250/281; 250/282; 250/287

(58) Field of Classification Search ..... 250/281, 250/282, 287, 288
See application file for complete search history.

(56) References Cited

U.S. PATENT DOCUMENTS 5,338,930 A 8/1994 Chu et al.
5,965,884 A 10/1999 Laiko et al.
6,548,263 B1 4/2003 Kapur et al.
6,656,690 B2 12/2003 Crooke et al.
6,744,046 B2 6/2004 Valaskovic et al.
6,941,033 B2 9/2005 Taylor et al.
6,949,741 B2 9/2005 Cody et al.
6,989,528 B2 1/2006 Schultz et al.
6,991,903 B2 1/2006 Fu et al.
7,084,396 B2 8/2006 Schneider
7,091,483 B2 8/2006 Fischer et al.
7,112,785 B2 9/2006 Laramee et al.
7,129,483 B2 10/2006 Youngquist et al.
7,170,052 B2 1/2007 Furutani et al.
7,271,397 B2 9/2007 Bryden et al.
7,335,897 B2 2/2008 Takats et al.
7,525,105 B2 4/2009 Kovtoun
7,577,538 B2 8/2009 Wang
7,629,576 B2 12/2009 Schultz et al.

(Continued)

FOREIGN PATENT DOCUMENTS

DE 10310518 A1 10/2004

(Continued)

OTHER PUBLICATIONS

Huang, et al ("Direct Protein Detection from Biological Media through Electrospray-Assisted Laser Desorption Ionization/Mass Spectrometry," J. Proteome Research 5, 2006 pp. 1107-1116; cited in parent application, copy in IFW).*

(Continued)

*Primary Examiner* — Michael Maskell

(74) *Attorney, Agent, or Firm* — K&L Gates LLP

(57) ABSTRACT

The field of the invention is atmospheric pressure mass spectrometry (MS), and more specifically a process and apparatus which combine infrared laser ablation with electrospray ionization (ESI).

20 Claims, 12 Drawing Sheets

U.S. PATENT DOCUMENTS

| | | | | |
|---|---|---|---|---|
| 7,687,772 | B2 | 3/2010 | Shiea et al. | |
| 7,696,475 | B2 | 4/2010 | Shiea et al. | |
| 7,714,276 | B2 | 5/2010 | Pevsner et al. | |
| 7,735,146 | B2 | 6/2010 | Vertes et al. | |
| 7,783,429 | B2 | 8/2010 | Walden et al. | |
| 7,964,843 | B2 | 6/2011 | Vertes et al. | |
| 2005/0029444 | A1 | 2/2005 | Caprioli | |
| 2006/0138317 | A1* | 6/2006 | Schultz et al. | 250/287 |
| 2008/0020474 | A1 | 1/2008 | Hayashizaki et al. | |
| 2008/0116366 | A1 | 5/2008 | Shiea et al. | |
| 2008/0128614 | A1 | 6/2008 | Nikolaev et al. | |
| 2008/0308722 | A1* | 12/2008 | Shiea | 250/281 |
| 2009/0027892 | A1 | 1/2009 | Bremerich et al. | |
| 2009/0261243 | A1 | 10/2009 | Bamberger et al. | |
| 2009/0272892 | A1 | 11/2009 | Vertes et al. | |
| 2009/0272893 | A1 | 11/2009 | Hieftje et al. | |
| 2009/0321626 | A1 | 12/2009 | Vertes et al. | |
| 2010/0090101 | A1 | 4/2010 | Schultz et al. | |
| 2010/0090105 | A1 | 4/2010 | Liang et al. | |
| 2010/0252435 | A1 | 10/2010 | Weber | |
| 2010/0285446 | A1 | 11/2010 | Vertes et al. | |

FOREIGN PATENT DOCUMENTS

| | | | |
|---|---|---|---|
| JP | 2005-98909 | A | 4/2005 |
| WO | WO 96/32504 | A2 | 10/1996 |
| WO | WO 99/45150 | A1 | 9/1999 |
| WO | WO 00/52455 | A1 | 9/2000 |
| WO | WO 00/77821 | A2 | 12/2000 |
| WO | WO 01/25486 | A1 | 4/2001 |
| WO | WO 02/055189 | A2 | 7/2002 |
| WO | WO 02/070664 | A2 | 9/2002 |
| WO | WO 02/071066 | A1 | 9/2002 |
| WO | WO 02/095362 | A2 | 11/2002 |
| WO | WO 03/093817 | A2 | 11/2003 |
| WO | WO 03/100035 | A2 | 12/2003 |
| WO | WO 2004/013602 | A2 | 2/2004 |
| WO | WO 2004/044554 | A2 | 5/2004 |
| WO | WO 2004/044555 | A2 | 5/2004 |
| WO | WO 2004/076612 | A2 | 9/2004 |
| WO | WO 2004/088271 | A2 | 10/2004 |
| WO | WO 2004/097427 | A1 | 11/2004 |
| WO | WO 2005/024046 | A2 | 3/2005 |
| WO | WO 2005/031304 | A2 | 4/2005 |
| WO | WO 2005/033271 | A2 | 4/2005 |
| WO | WO 2006/014984 | A1 | 2/2006 |
| WO | WO 2006/023398 | A2 | 3/2006 |
| WO | WO 2006/026020 | A2 | 3/2006 |
| WO | WO 2006/048642 | A2 | 5/2006 |
| WO | WO 2006/054101 | A2 | 5/2006 |
| WO | WO 2006/059123 | A2 | 6/2006 |
| WO | WO 2006/061593 | A2 | 6/2006 |
| WO | WO 2006/061625 | A2 | 6/2006 |
| WO | WO 2006/064274 | A2 | 6/2006 |
| WO | WO 2006/064280 | A2 | 6/2006 |
| WO | WO 2006/067495 | A2 | 6/2006 |
| WO | WO 2006/085110 | A2 | 8/2006 |
| WO | WO 2006/129094 | A2 | 12/2006 |
| WO | WO 2007/052025 | A2 | 5/2007 |

OTHER PUBLICATIONS

Stockle et al., "Nanoscale Atmospheric Pressure Laser Ablation-Mass Spectrometry", Analytical Chemistry, Apr. 1, 2001, vol. 73, No. 7, pp. 1399-1402.

Coon J. and Harrison W., "Laser Desorption-Atmospheric Pressure Chemical Ionization Mass Spectrometry for the Analysis of Peptides from Aqueous Solution", Analytical Chemistry, Nov. 1, 2002, vol. 74, No. 21, pp. 5600-5605.

Rasmussen et al., "New Dimension in Nano-Imaging: Breaking Through the Diffraction Limit with Scanning Near-Field Optical Microscopy", Anal Bioanal Chem., 2005, vol. 381, pp. 165-172.

Huang et al., "Direct Protein Detection from Biological Media through Electrospray-Assisted Laser Desorption Ionization/Mass Spectrometry", Journal of Proteome Research, vol. 5, No. 5, 2006, pp. 1107-1116.

Takats et al., "Mass Spectrometry Sampling Under Ambient Conditions with Desorption Electrospray Ionization", Science Magazine, vol. 306, Oct. 15, 2004, pp. 471-473.

Cody et al., "Versatile New Ion Source for the Analysis of Materials in Open Air under Ambient Conditions", Analytical Chemistry, vol. 77, No. 8, Apr. 15, 2005, pp. 2297-2302.

Nemes, Peter and Akos Vertes, "Laser Ablation Electrospray Ionization for Atmospheric Pressure, in Vivo and Imaging Mass Spectrometry", Analytical Chemistry, Nov. 1, 2007, vol. 79, No. 21, American Chemical Society, published on Web Sep. 27, 2007, pp. 8098-8106.

Nemes et al., "Simultaneous Imaging of Small Metabolites and Lipids in Rat Brain Tissues at Atmospheric Pressure by Laser Ablation Electrospray Ionization Mass Spectrometry", Analytical Chemistry, vol. 82, No. 3, Feb. 1, 2010, pp. 982-988.

Shrestha, Bindesh and Akos Vertes, "In Situ Metabolic Profiling of Single Cells by Laser Ablation Electrospray Ionization Mass Spectrometry", Analytical Chemistry, vol. 81, No. 20, Oct. 15, 2009, pp. 8265-8271.

Sampson et al., "Intact and Top-Down Characterization of Biomolecules and Direct Analysis Using Infrared Matrix-Assisted Laser Desorption Electrospray Ionization Coupled to FT-ICR Mass Spectrometry", Journal of the American Society for Mass Spectrometry, 2009, vol. 20, pp. 667-673.

Rezenom et al., "Infrared laser-assisted desorption electrospray ionization s spectrometry", The Analyst, 2008, vol. 133, pp. 226-232.

Shrestha, Bindesh Akos Vertes, "Ablation and analysis of small cell populations and single cells by consecutive laser pulses", Applied Physics A, presented at the 10th international Conference on Laser Ablation, 2009, Singapore, published online Jun. 3, 2010, 6 pages.

Edwards at al., "Free-electron-laser-based biophysical and biomedical instrumentation", Review of Scientific Instruments, vol. 74, No. 7, Jul. 2003, pp. 3207-3245.

Boskey, Adele and N. Camacho, "FT-IR Imaging of Native and Tissue-Engineered Bone and Cartilage", Biomaterials, May 2007, 28(15), pp. 2455-2478.

Cramer et al., "Matrix-assisted laser desorption and ionization in the O-H and C=O absorption bands of aliphatic and aromatic matrices: dependence on laser wavelength and temporal beam profile", International Journal of Mass Spectrometry and Ion Processes, 169/170, 1997, pp. 51-67.

"Generation of three-dimensional images in mass spectrometry", Technology Access offered by Hessische Intellectual Property Offensive, TransMIT Society for Technology Transfer Department of Patents and Innovations, May 16, 2003, printed from http://www.hipo-online.de/files/Exp_Hipo_3D_MS_EN_160503.pdf, 2 pages.

* cited by examiner

THREE-DIMENSIONAL MOLECULAR IMAGING BY INFRARED LASER ABLATION ELECTROSPRAY IONIZATION MASS SPECTROMETRY

CROSS-REFERENCE TO RELATED APPLICATIONS

This application is a continuation of U.S. application Ser. No. 12/323,276, filed on Nov. 25, 2008 now U.S. Pat. No. 7,964,843, which is a continuation-in-part of U.S. application Ser. No. 12/176,324, filed on Jul. 18, 2008 now U.S. Pat. No. 8,067,730, which claims priority to U.S. provisional application Ser. No. 60/951,186, filed on Jul. 20, 2007, each of the foregoing applications are hereby incorporated herein by reference in their entireties.

STATEMENT OF GOVERNMENTAL INTEREST

Portions of this invention were made with United States government support under Grant No. 0719232 awarded by the National Science Foundation and Grant No. DEFG02-01ER15129 awarded by the Department of Energy. The government has certain rights in the invention.

BACKGROUND

The field of the invention is atmospheric pressure mass spectrometry (MS), and more specifically a process and apparatus which combine infrared laser ablation with electrospray ionization (ESI) to provide three-dimensional molecular imaging of chemicals in specimens, for example, metabolites in live tissues or cells.

Three-dimensional (3D) tissue or cell imaging of molecular distributions offers insight into the correlation between biochemical processes and the spatial organization of cells in a tissue. Presently available methods generally rely on the interaction of electromagnetic radiation (e.g., magnetic resonance imaging and fluorescence or multiphoton microscopy) or particles (e.g., secondary ion mass spectrometry, SIMS) with the specimen. For example, coherent anti-Stokes Raman scattering provides exquisite lateral and depth resolution for in vivo imaging of lipid distributions on cellular or subcellular level. They, however, typically report on only a few species and often require the introduction of molecular labels. These obstacles are less pronounced in methods based on mass spectrometry (MS) that report the distributions for diverse molecular species. Imaging by SIMS and matrix-assisted laser desorption ionization (MALDI) are appealing because they capture the two- and three-dimensional distributions of endogenous and drug molecules in tissue and whole-body sections. Characteristic to these methods is the requirement for delicate chemical and physical sample manipulation and the need to perform the imaging experiment in vacuum, preventing the study of live specimens.

Ambient MS circumvents these limitations by bringing the ionization step into the atmosphere while minimizing chemical and physical treatment to the sample. During the past few years, this field has experienced rapid development providing us with an array of ambient ion sources. Desorption electrospray ionization (DESI) in combination with MS has been successful in various applications, including the detection of drugs, metabolites and explosives on human fingers, and the profiling of untreated bacteria. Most recently, DESI and extractive electrospray ionization have been used in metabolomic fingerprinting of bacteria. In atmospheric pressure (AP) IR-MALDI and in MALDESI, a combination of MALDI and DESI, the energy necessary for the desorption and ionization of the analyte is deposited by a mid-IR and a UV laser, respectively. In electrospray laser desorption ionization (ELDI) the efficiency of ion production by a UV laser is enhanced by postionization using an electrospray source.

Laser ablation electrospray ionization (LAESI) is an ambient technique for samples with high water content, e.g., cells, biological tissues, aqueous solutions or wetted surfaces. The sample may be reconstituted in deionized water. LAESI achieves ionization from samples with a considerable absorption at about 3 μm wavelength. A laser pulse at about 2.9 μm wavelength ablates a minute volume of the sample to eject fine neutral particles and/or molecules. This laser plume is intercepted by an electrospray and the ablated material is efficiently ionized to produce mass spectra similar to direct electrospray ionization. With LAESI we have demonstrated metabolic analysis of less than 100 ng tissue material from volumes below 100 pL. As in LAESI the laser energy is absorbed by the native water in the sample, the photochemical damage of the biologically relevant molecules, such as DNA, peptides, proteins and metabolites is negligible.

Ambient imaging mass spectrometry (IMS) captures the spatial distribution of chemicals with molecular specificity. Unlike optical imaging methods, IMS does not require color or fluorescent labels for successful operation. A handful of MS-based techniques has demonstrated molecular two dimensional (2D) imaging in AP environment: AP IR-MALDI and DESI captured metabolite transport in plant vasculature and imaged drug metabolite distributions in thin tissue sections, respectively. Recently, through 2D imaging LAESI provided insight into metabolic differences between the differently colored sectors of variegated plants. The lateral resolution of these methods generally ranged from 100 to 300 μm. For AP MALDI and LAESI, improved focusing of the incident laser beam, oversampling, and the use of sharpened optical fibers for ablation could offer further advances in spatial resolution, whereas for DESI imaging, decreased solution supply rates, smaller emitter sizes and the proper selection of the nebulizing gas velocity and scan direction were found beneficial.

Post mortem tissue degradation and loss of spatial integrity during sample preparation are serious concerns in the investigation of biological systems. Cryomicrotoming and freeze-fracture techniques generally practiced in IMS experiments aim to minimize chemical changes during and after tissue and cell preparations. Further complications may arise due to analyte migration in the matrix coating step of MALDI experiments. In vivo analyses circumvent these problems by probing the chemistry of samples in situ. For example, LAESI mass spectrometry reveals the tissue metabolite composition within the timeframe of a few seconds. Instantaneous analysis and no requirement for sample preparation make this approach promising for in vivo studies.

Volume distributions of molecules in organisms are of interest in molecular and cell biology. Recently LAESI MS showed initial success in depth profiling of metabolites in live plant tissues but 3D imaging is not yet available for the ambient environment.

SUMMARY

Here, we describe 3D molecular imaging by the combination of lateral imaging and depth profiling with, as an example, resolutions of about 300-350 μm and about 30-40 μm, respectively. In the example, we used LAESI 3D IMS to monitor the distribution of xenobiotics deposited on the leaves of Peace lily (*Spathiphyllum Lynise*) and endogenous metabolites in live Zebra plant (*Aphelandra Squarrosa*) leaves. In good agreement with literature results obtained by conventional techniques that required extensive physical and chemical processing of the samples, the molecular images revealed that the compound distributions were specific to the anatomy of the leaves. The 3D localization of select metabolites was correlated with their biological roles in live plant tissues.

In one preferred embodiment, a process and apparatus is provided which combine infrared laser ablation with electrospray ionization (ESI) to provide three-dimensional molecular imaging of metabolites in live tissues or cells. This allows a live sample to be directly analyzed 1) without special preparation and 2) under ambient conditions. The ions which can be analyzed using this process include but are not limited to metabolites, lipids and other biomolecules, pharmaceuticals, dyes, explosives, narcotics and polymers.

In general terms, the invention starts with using a focused IR laser beam to irradiate a sample thus ablating a plume of ions and particulates. This plume is then intercepted with charged electrospray droplets. From the interaction of the laser ablation plume and the electrospray droplets, gas phase ions are produced that are detected by a mass spectrometer. This is performed at atmospheric pressure.

In a preferred embodiment, there is provided a method for the three-dimensional imaging of a live tissue or cell sample by mass spectrometry, comprising: subjecting the live tissue or cell sample to infrared LAESI mass spectrometry, wherein the LAESI-MS is performed using a LAESI-MS device directly on the live tissue or cell sample wherein the sample does not require conventional MS pre-treatment and is performed at atmospheric pressure, wherein the LAESI-MS device is equipped with a scanning apparatus for lateral scanning of multiple points on a grid or following the cellular pattern or regions of interest that is defined on the live tissue or cell sample, and for depth profiling of each point on the grid or following the cellular pattern or regions of interest by performing multiple ablations at each point, each laser pulse of said ablations ablating a deeper layer of the live tissue or cell sample than a prior pulse, wherein the combination of lateral scanning and depth profiling provides three-dimensional molecular distribution imaging data.

In another preferred embodiment, there is provided an ambient ionization process for producing three-dimensional imaging of a sample, which comprises: irradiating the sample with an infrared laser to ablate the sample; intercepting this ablation plume with an electrospray to form gas-phase ions; and analyzing the produced ions using mass spectrometry, wherein the LAESI-MS is performed using a LAESI-MS device directly on the live tissue or cell sample wherein the sample does not require conventional chemical/physical preparation and is performed at atmospheric pressure, wherein the LAESI-MS device is equipped with a scanning apparatus for lateral scanning of multiple points on a grid or following the cellular pattern or regions of interest that is defined on the live tissue or cell sample, and for depth profiling of each point on the grid or following the cellular pattern or regions of interest by performing multiple ablations at each point, each laser pulse of said ablations ablating a deeper layer of the live tissue or cell sample than a prior pulse, wherein the combination of lateral scanning and depth profiling provides three-dimensional molecular distribution imaging data.

In another preferred embodiment, there is provided the processes above, wherein LAESI-MS detects ions from target molecules within the sample, said ions selected from the group consisting of pharmaceuticals, metabolites, dyes, explosives or explosive residues, narcotics, polymers, chemical warfare agents and their signatures, peptides, oligosaccharides, proteins, metabolites, lipids and other biomolecules, synthetic organics, drugs, and toxic chemicals.

In another preferred embodiment, there is provided a LAESI-MS device for three-dimensional imaging of a sample, comprising: a pulsed infrared laser for emitting energy at the sample; an electrospray apparatus for producing a spray of charged droplets; a mass spectrometer having an ion transfer inlet for capturing the produced ions; and a scanning apparatus for lateral scanning of multiple points on a grid or following the cellular pattern or regions of interest that is defined on the sample, and for depth profiling of each point on the grid or following the cellular pattern or regions of interest by controlling the performing of multiple ablations at each point, each laser pulse of said ablations ablating a deeper layer of the sample than a prior pulse, wherein the combination of lateral scanning and depth profiling provides three-dimensional molecular distribution imaging data.

In another preferred embodiment, there is provided the device herein, further comprising wherein the LAESI-MS is performed at atmospheric pressure.

In another preferred embodiment, there is provided the device herein, further comprising an automated feedback mechanism to correct for variances in water content and tensile strength of the sample by continuously adjusting laser energy and/or laser wavelength while recording the depth of ablation for each pulse.

In another preferred embodiment, there is provided the device herein, wherein LAESI-MS detects ions from target molecules within the sample, said ions selected from the group consisting of pharmaceuticals, dyes, explosives or explosive residues, narcotics, polymers, chemical warfare agents and their signatures, peptides, oligosaccharides, proteins, metabolites, lipids, and other biomolecules, synthetic organics, drugs, and toxic chemicals.

In another preferred embodiment, there is provided a method for the direct chemical analysis of a sample by mass spectrometry, comprising: subjecting a sample to infrared LAESI mass spectrometry, wherein the sample is selected from the group consisting of pharmaceuticals, dyes, explosives, narcotics, polymers, tissue or cell samples, and biomolecules, and wherein the LAESI-MS is performed using a LAESI-MS device directly on a sample wherein the sample does not require conventional MS pre-treatment and is performed at atmospheric pressure.

BRIEF DESCRIPTION OF THE FIGURES

The patent or application file contains at least one drawing executed in color. Copies of this patent or patent application publication with color drawing(s) will be provided by the Office upon request and payment of the necessary fee.

FIG. 1 shows the top view of the interrogated area with an array of ablation marks. Some rhodamine 6G dye from the bottom surface is visible through the ablation holes. Brown discoloration surrounding the edges of the analysis area was linked to dehydration and/or oxidation. Combination of lateral scanning and depth profiling provided the 3D molecular distributions.

FIG. 2 shows the ion intensities from basic blue 7 (m/z 478.3260 in blue), rhodamine 6G (m/z 443.2295 in orange/wine) and leucine (m/z 154.0819 in grey/black) on false color scales. The ion distributions for the two dyes paralleled the mock patterns shown in the optical image. Higher abundances of the endogenous metabolite leucine were observed in the top two layers.

FIG. 3 shows the distribution of cyanidin/kaempferol rhamnoside glucoside (m/z 595.1649 in grey). Higher abundances were found in the epidermal region, asserting its hypothesized role in the protection against the detrimental effects of UV-A and B irradiation on the underlying photosynthetic cells.

FIG. 4 shows the molecular distribution pattern for protonated chlorophyll a (m/z 893.5425 in cyan/royal blue). The molecular distribution pattern showed accumulation in the spongy mesophyll region, in agreement with the known localization of chloroplasts within plant tissues.

FIGS. 5 and 6 present representative mass spectra acquired for the first and second laser shots, respectively. They indicated that flavonoids (m/z 383.1130) and cyanidin/kaempferol rhamnoside glucoside (m/z 595.1649) were present at higher abundances in the top 30-40 μm section of the tissue. For the second pulse, which sampled 40 to 80 μm deep from the top cuticle, a handful of ions, i.e., m/z 650.4, 813.5, 893.5, and 928.6, emerged in the m/z 600-1000 region.

Table 1 shows the tentative assignment of the observed ions was achieved on the basis of accurate mass measurement, collision-activated dissociation, isotope peak distribution analysis, and a wide plant metabolome data-base search. The mass accuracy, Δm, is the difference between the measured and calculated monoisotopic masses.

DETAILED DESCRIPTION

Recent advances in biomedical imaging enable the determination of three-dimensional molecular distributions in tissues with cellular or subcellular resolution. Most of these methods exhibit limited chemical selectivity and are specific to a small number of molecular species. Simultaneous identification of diverse molecules is a virtue of mass spectrometry that in combination with ambient ion sources, such as laser ablation electrospray ionization (LAESI), enables the in vivo investigation of biomolecular distributions and processes. Here, we introduce three-dimensional (3D) imaging mass spectrometry (IMS) with LAESI that enables the simultaneous identification of a wide variety of molecular classes and their 3D distributions in the ambient. We demonstrate the feasibility of LAESI 3D IMS on Peace lily y (*Spathiphyllum Lynise*) and build 3D molecular images to follow secondary metabolites in the leaves of the variegated Zebra plant (*Aphelandra Squarrosa*). The 3D metabolite distributions are found to exhibit tissue-specific accumulation patterns that correlate with the biochemical roles of these chemical species in plant defense and photosynthesis. These results describe the first examples of 3D chemical imaging of live tissue with panoramic identification on the molecular level. Abbreviations: AP—Atmospheric Pressure; DESI—Desorption Electrospray Ionization; ESI—Electrospray Ionization; and LAESI—Laser Ablation Electrospray Ionization.

A. RESULTS AND DISCUSSIONS

1. Three-Dimensional Molecular Imaging

Initially the 3D molecular imaging capability of LAESI was evaluated in proof of principle experiments. The adaxial and abaxial surfaces of an *S. Lynise* leaf were marked with about 1 mm wide right angle lines and a 4 mm diameter spot with basic blue 7 and rhodamine 6G dyes, respectively. Laser pulses of 2.94 μm wavelength were focused on the adaxial (upper) surface of this mock sample and a six step depth profile of the tissue was acquired for each point on a 22×26 grid across a 10.5×12.5 $mm^2$ area. Each of the resulting 3,432 cylindrical voxels with 350 nm diameter and 40 nm height, i.e., about 4 nL analysis volume, yielded a high resolution mass spectrum. Microscopic inspection revealed that the exposed surfaces of the *S. Lynise* epidermal cells were elliptical in shape with axes of about 20 μm and about 60 μm. The average height of the cells measured 15 μm. Thus, each about 4 nL imaging voxel sampled about 300 cells for analysis.

Figure 1:
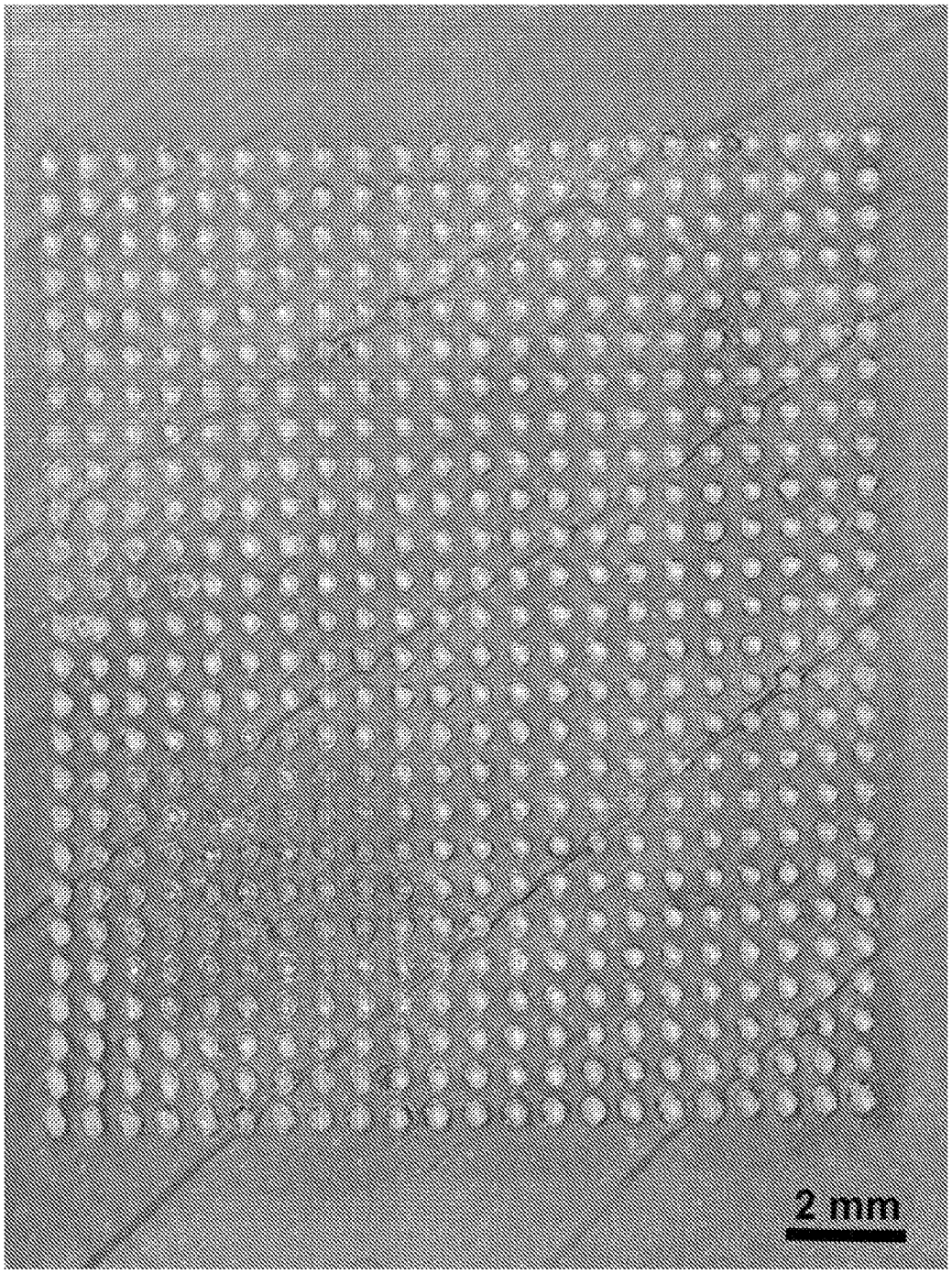
FIGS. 1-4: Three-dimensional imaging with LAESI MS was demonstrated on leaf tissues of *S. Lynise*. The adaxial and the abaxial cuticles were marked with right angle lines and a spot colored in basic blue 7 and rhodamine 6G, respectively.

The top view of the leaf following LAESI 3D IMS can be seen in FIG. 1. The interrogated area was marked by an array of about 350 μm diameter ablation spots with a displacement of 500 μm in both directions. This lateral step size yielded about 2-3 pixels to sample across the width of the lines drawn in basic blue 7. A circular Rhodamine 6G dye pattern from the marking of the back side can be seen in the lower left corner of the image, indicating complete tissue removal in 6 laser pulses. Scanning electron microscopy images confirmed that the first laser pulse successfully removed the protective waxy cuticle layer.

Figure 5:
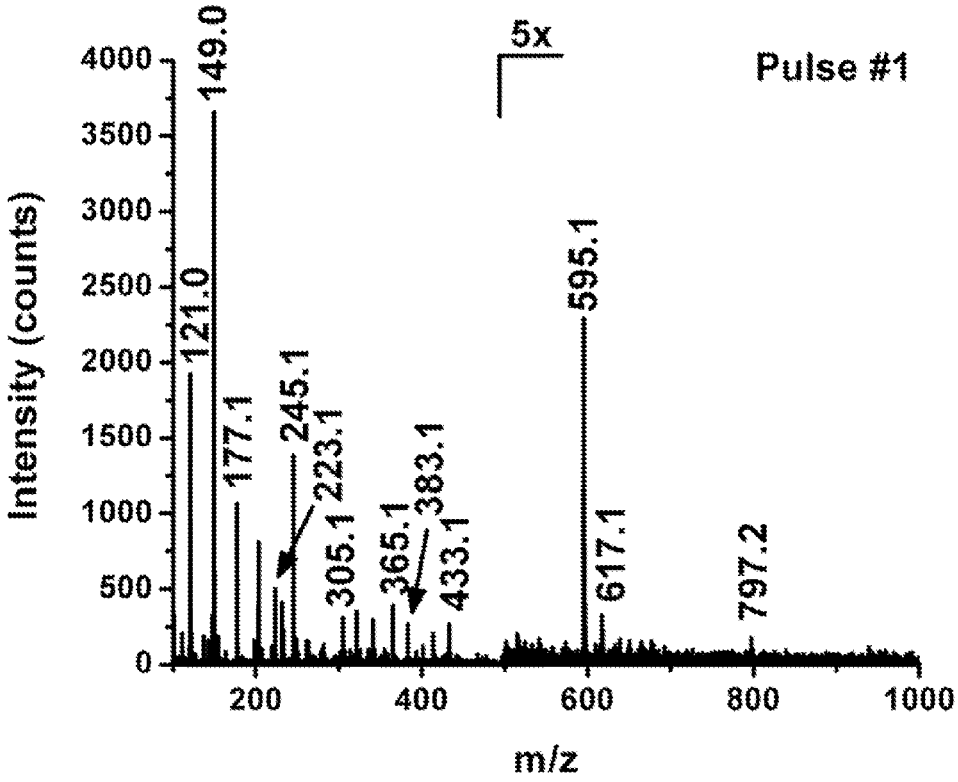
FIGS. 5-6: For the depth imaging of *S. Lynise* leaves, six successive single laser pulses were delivered to the adaxial surface. Mass analysis of the generated ions indicated varying tissue chemistry with depth.
Figure 6:
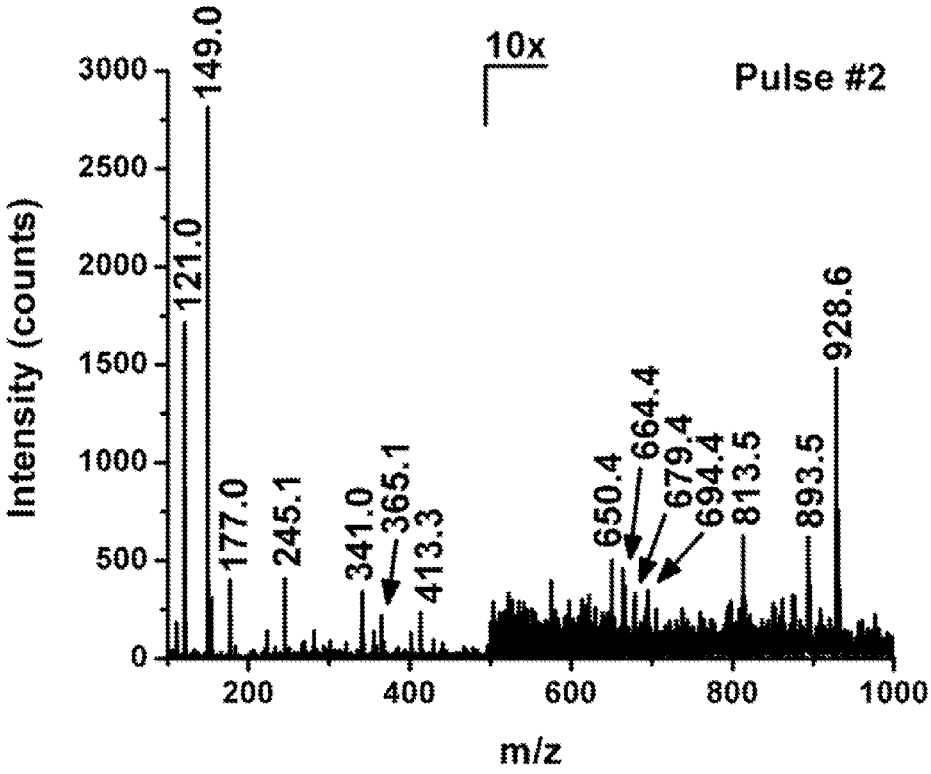

For all laser pulses focused on the adaxial (upper) surface of the leaflet, information rich mass spectra were recorded. Numerous ions were tentatively assigned on the basis of accurate mass measurements, isotope distribution analysis and collision-activated dissociation experiments combined with broad plant metabolomic database searches. The databases at the http://www.arabidopsis.org, http://biocyc.org, and http://www.metabolomejp websites were last accessed on Oct. 29, 2008. Detailed analysis of the recorded mass spectra indicated that the tissue chemistry varied with depth. FIGS. 5 and 6 present representative mass spectra for the first and second laser pulses, respectively. Cyanidin rhamnoside and/or luteolinidin glucoside (m/z 433.1125) and cyanidin/kaempferol rhamnoside glucoside (m/z 595.1649) were generally observed at higher abundances in the top 40 μm section of the tissue. At the second pulse, which sampled the layer between 40 μm and 80 μm from the top surface, new ions emerged in the m/z 600 to 1000 region of the spectrum. Singly charged ions characteristic to this section were observed at m/z 650.4, 813.5, 893.5, and 928.6. Other ions, such as m/z 518.4, 609.4, 543.1, and 621.3 were observed at higher abundances during the third, fourth, fifth and six laser pulses, respectively.

Figure 2:
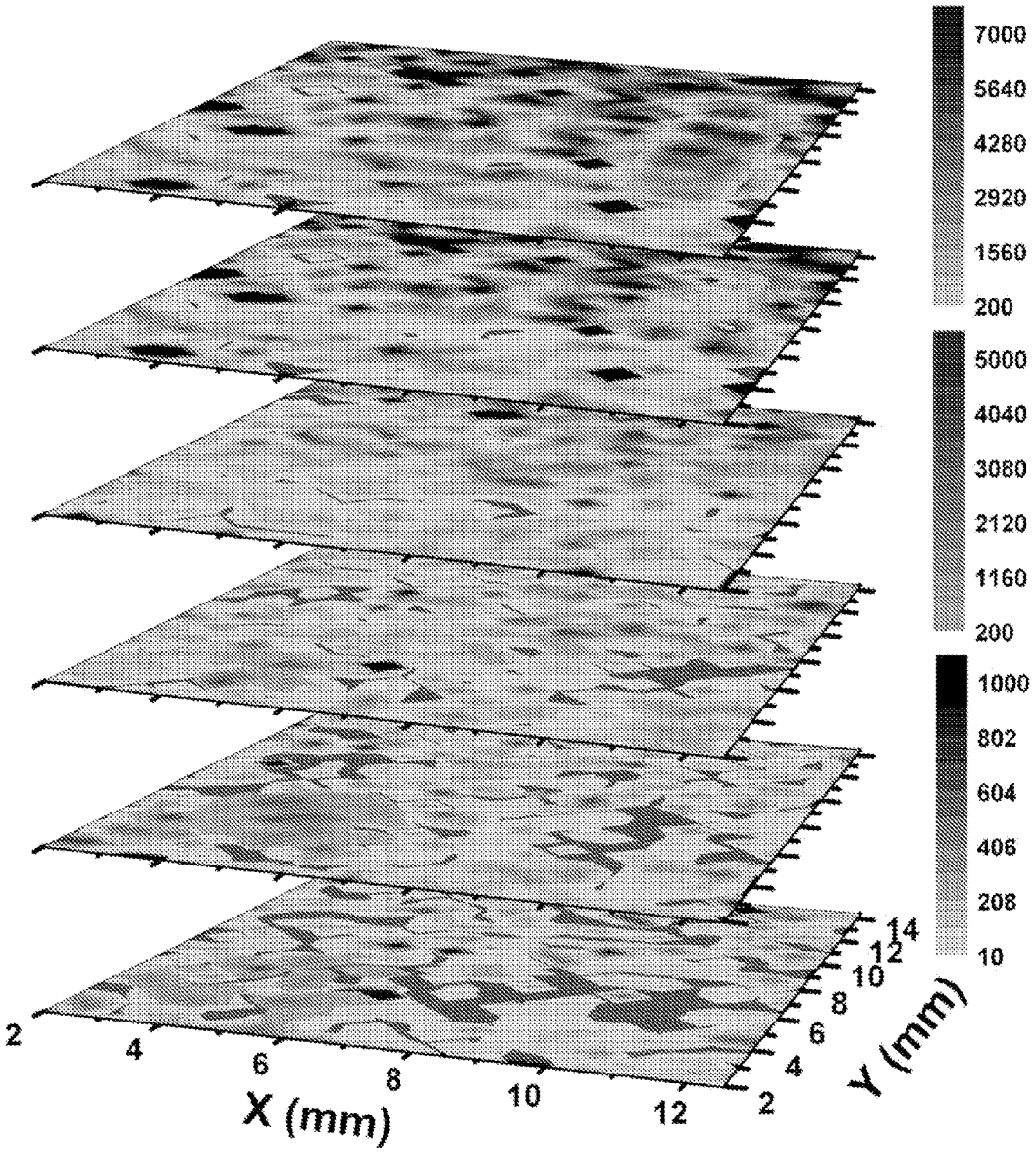

The lateral and cross-sectional localization of mass-selected ions were followed in three dimensions. The color-coded contour plots in FIG. 1 demonstrate the localization of the dye ions and some endogenous metabolites in the plant organ. Each layer represents a 40 μm thick section of the leaf tissue sampled by successive ablations. The two-dimensional distribution of the basic blue 7 dye ion, $[C_{33}H_{40}N_3]^+$ detected at m/z 478.3260, in the top layer of FIG. 2 was in very good correlation with its optical pattern recorded prior to the imaging experiment (compare with FIG. 1). Although the basic blue 7 dye was applied on the top cuticle of the leaf, its molecular ion was also noticed at low intensities in the second layer. Optical investigation of marked *S. Lynise* leaf surfaces revealed that during prolonged contact with the marker pen, the ink occasionally seeped through the tissue as far as the cuticle on the opposite side. Thus, marking times were minimized to restrict cross-sectional transport during the mock sample preparation. We attributed the limited presence of the dye in the second layer to this cross-sectional transport. However, increasing crater sizes during consecutive ablations due to the Gaussian profile of the beam intensity and varying ablation depths linked to changing water content or tensile strengths could also play a role.

The molecular ion of the rhodamine 6 G dye, $[C_{28}H_{31}N_2O_3]^+$ with a measured m/z 443.2295, was found at high abundances in the fifth and six layers. FIG. 1B shows the lateral distribution patterns of the dye ion in the bottom two layers agree well with the marked spot on the adaxial cuticle shown in the optical image (see FIG. 1 for comparison). These results confirmed the feasibility of lateral imaging with LAESI at varying depths of the tissue. Low levels of the rhodamine 6G ion was present in the fourth layer as well, indicating enhanced cross-sectional transport compared to the top surface where only 2 layers were affected.

In response to short- and long-term fluctuations in the environment over the last 400 million years, plants have evolved to have adaxial cuticles generally thinner with a higher density of stomata than the upper surface. These pores are responsible for regulating gas and water exchange with the environment. In addition to their natural role, the stomata potentially facilitated transport of the dye solution to deeper layers of the leaflet in our experiments. Reduced cuticle thickness on the abaxial surface likely also enhanced these effects, explaining the more pronounced transport of the red dye.

Close inspection of FIG. 1 reveals darkening of the chlorophyllous tissue surrounding the interrogated area. We attributed this observation to uncontrolled dehydration and/or oxidation of the exposed tissue in air; an effect that likely accelerated during the time course of the 3D imaging experiment. At longer time scales (about 1 hour), tissue discoloration was also noticed in areas where the leaf tissue was physically cut, indicating that this effect was not caused by the laser radiation, rather it occurred as a consequence of dehydration and/or oxidation.

Figure 3:
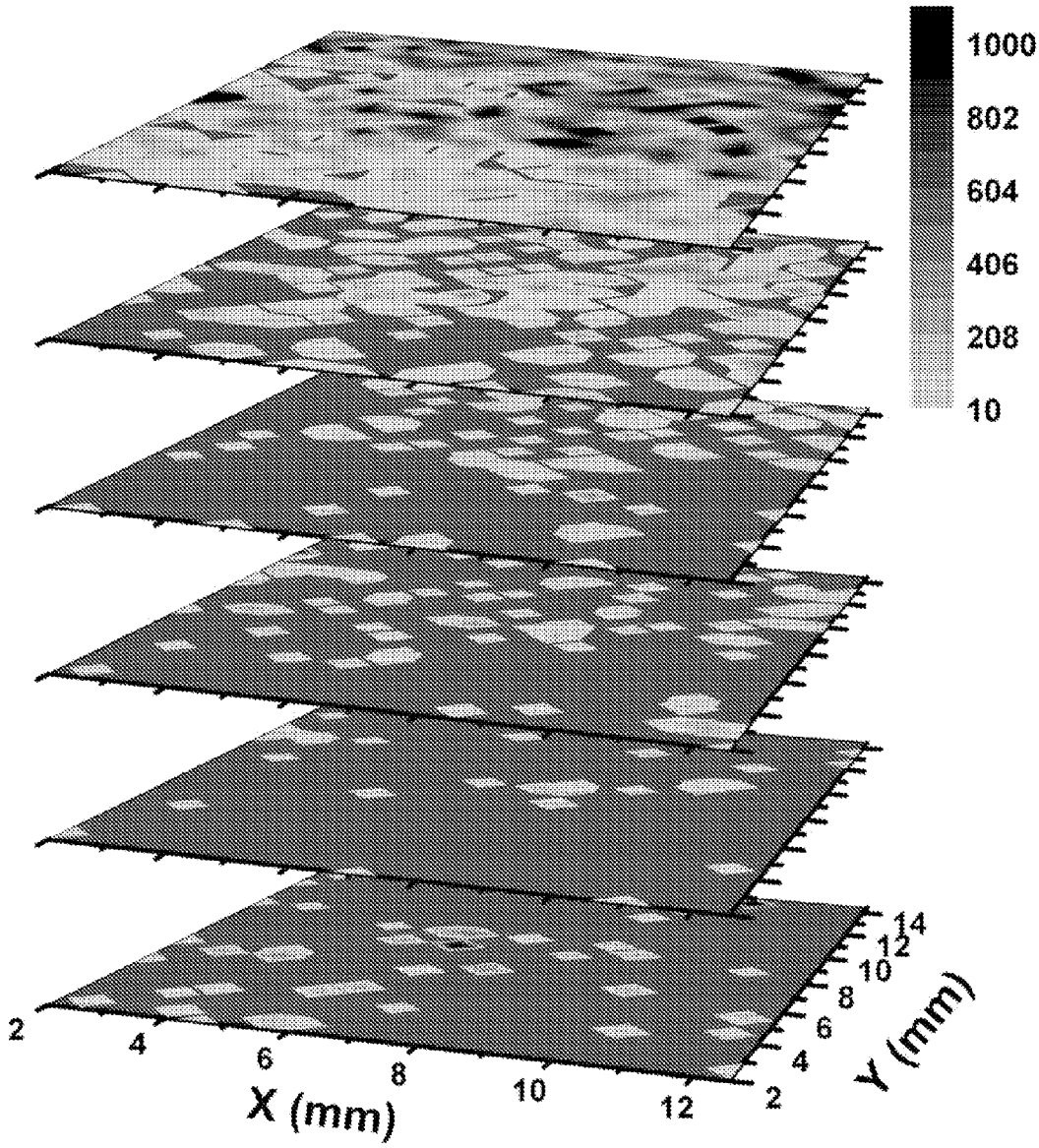

Various plant metabolites exhibited characteristic 3-dimensional patterns. For example, the distribution of the protonated leucine ion can be seen in FIG. 2 on a grey-to-black false color scale. This amino acid was observed across the entire tissue (S/N>>3) with higher ion counts in the top 80 μm section. In contrast, the molecular ion of cyanidin/kaempferol rhamnoside glucoside (m/z 595.1649) along with other secondary metabolites (e.g., cyanidin/luteolinidin rhamnoside) was uniquely linked to the upper 40 μm of the tissue (FIG. 3).

The tentative identification of the observed metabolites along with the layers of their accumulation, where appropriate, are summarized in Table 1. Independent methods showed that a higher concentration of kaempferol glycosides is often found in the upper epidermal layers. In leaves of rapeseed (*Brassica napus*), for example, mostly quercetin- and kaempferol-based UV-screening pigments are concentrated within the upper 40 μm of the leaf tissue, showing a very good agreement with our data. Plant flavonoids are thought to play a vital role in providing protection against the detrimental effects of solar radiation. By direct light absorption or scavenging harmful radicals such as reactive oxygen, these substances can create a barrier against the effect of UV-A and B rays, protecting the photosynthetic mesophyll cells and perhaps providing them with additional visible light via fluorescence. As proteins also have a major absorption band at 280 nm, this mechanism can also protect them from degradation in photosystems I and II.

Figure 4:
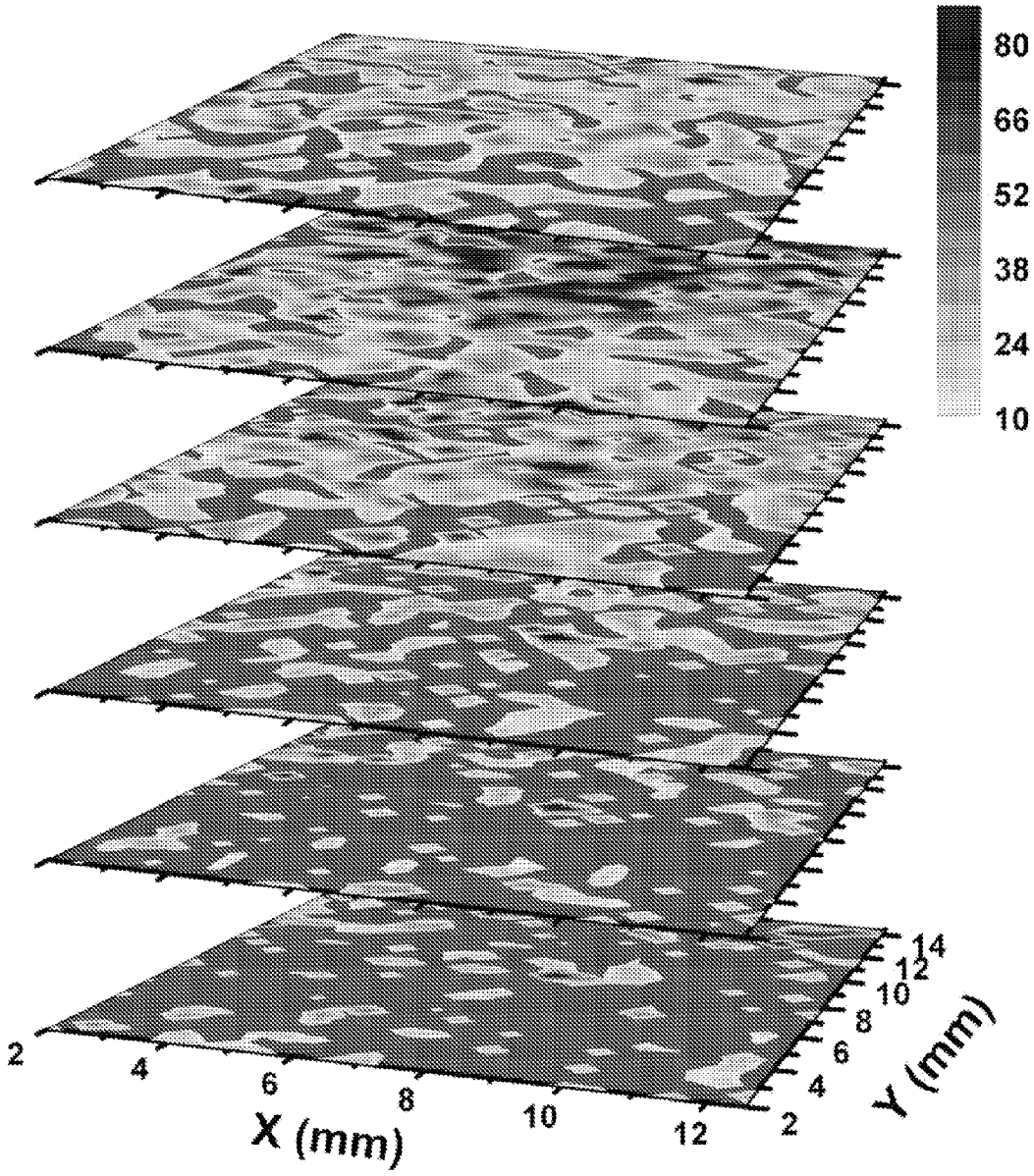

Other metabolites accumulated in the mesophyll layers of the leaf tissue. In every depth profile, the second laser pulse sampled the molecular composition of the palisade mesophyll layer between 40 μm and 80 μm. In this region mass analysis showed the presence of various ions in the m/z 600-1000 segment of the spectrum (see the mass spectrum in FIG. 6). Based on the accurate mass (see Table 1) and the isotopic distribution pattern of the m/z 893.5425 ion (76±4% and 50±8% for $M^{+1}$ and $M^{+2}$, respectively), we identified it as the protonated chlorophyll a molecule ($C_{55}H_{73}N_4O_5Mg^+$ with 77% and 43% for $M^{+1}$ and $M^{+2}$, respectively). Collision-activated dissociation of m/z 893.5425 yielded an abundant fragment at m/z 615.2, corresponding to the protonated form of the chlorophyllide a, $C_{35}H_{35}N_4O_5Mg^+$, as documented by other researchers. The 3D distribution of the chlorophyll a ion showed an accumulation of this species in the second, and to some degree, in the third layers, i.e., this ion was found between 40 μm and 120 μm below the adaxial cuticle (see FIG. 4). This 3D profile paralleled the biological localization of chlorophyll a in the chloroplasts of the palisade and spongy mesophyll layers where photosynthesis takes place.

The photosynthetic cycle is known to involve a variety of chlorophyll derivatives. In the imaging experiments, ions with m/z 813.4917, 852.5833, 860.5171, and 928.6321 exhibited similar 3D molecular patterns and isotopic distributions to that of [chlorophyll a +H]$^+$. These positive spatial correlations indicated potentially common biosynthetic or biodegradation pathways. Prolonged thermal treatment of vegetables (blanching, steaming, microwave cooking, etc.) has been described to yield m/z 813.5, a fragment of pyrochlorophyll a, supporting this scenario. Although elevated plume pressures and temperatures may facilitate chlorophyll a breakdown in the early phase of the ablation process (e.g., in conventional MALDI experiments), LAESI probes the neutrals and particulates that are ejected at a later phase when the sample is closer to thermal equilibrium with the environment. The time frame of sampling and mass analysis is tens of milliseconds, which is at least four orders of magnitude shorter than those needed to cause extensive chlorophyll a decomposition. Thus, we considered the ions observed in the m/z 600-1000 range to endogenous metabolites as opposed to compounds formed via chemical modifications of the chlorophyll a molecule.

2. Uncovering Metabolism and Tissue Architecture with LAESI 3D IMS

Detailed information on the localization of endogenous metabolites in three dimensions holds the potential to reveal metabolic aspects of organs that may not be accessible by lateral imaging techniques. The information obtained by LAESI 3D IMS promised to be useful in understanding plant variegations on the biological level. We chose the variegated leaves of *A. Squarrosa* as model organs in the experiments. Cells in the light yellow and in the chlorophyllous variegations sectors are of different genotype. Two-dimensional (2D) IMS with LAESI revealed metabolic differences between the two tissue sections. For example, the variegated sectors were found to accumulate kaempferol- and luteolin-based secondary metabolites. Lateral imaging, however, could not assign the origin of altered metabolite composition to the cells in the variegation pattern or in the vasculature. Metabolites synthesized in the veins can build up in the surroundings, leaving an array of secondary metabolites secreted in the cells of the variegation. Molecular analysis in 3D with LAESI IMS has the potential to differentiate between these scenarios.

Figure 8:
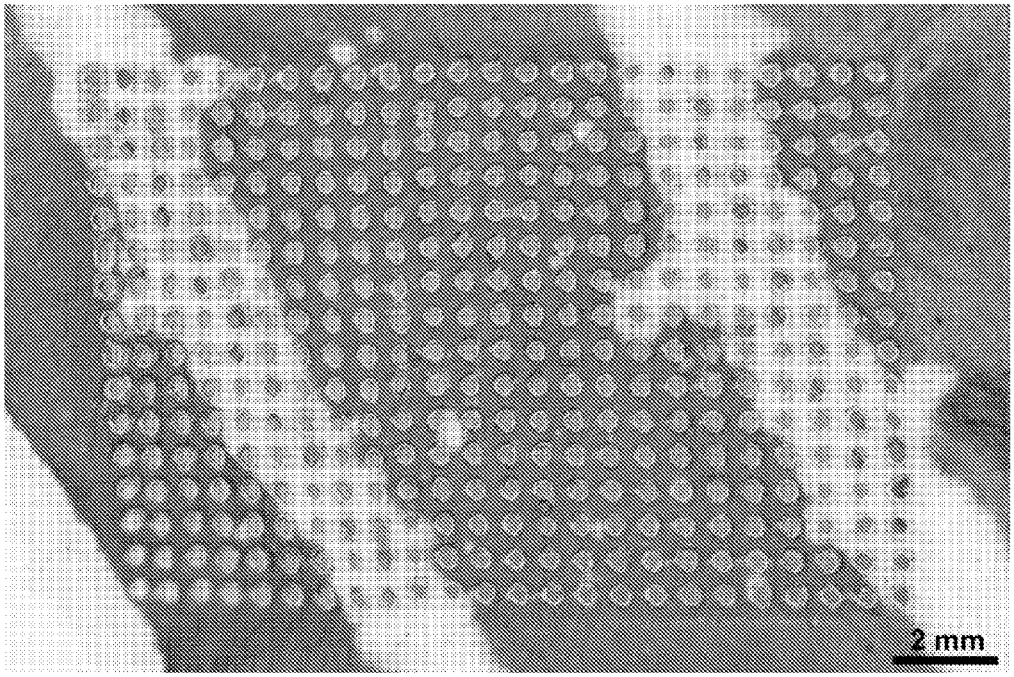
FIG. 8 shows a top view of the resulting array of circular 350 μm ablation marks on the leaf of *A. Squarrosa* of FIG. 7.

Leaves of *A. Squarrosa* demonstrated a higher tensile strength and thickness than those of *S. Lynise*. The incident laser energy was slightly increased to compensate for these effects and to obtain depth analysis with 6 laser pulses. The thickness of the selected leaf area for analysis was generally about 300-350 μm, corresponding to a depth resolution of 50-60 μm/pulse. In the yellow sectors the abaxial surface contained two parallel-running secondary veins that induced about 50-100 μm protrusions on the lower side of the lamina, producing a total thickness of 350-450 μm in these regions. The 3D chemical makeup of an 11.5×7.5 $mm^2$ area was probed on a 24×16×6 grid resulting in 2,304 voxels. As evidenced by the optical image (see the arrows in FIG. 8), six laser pulses were not sufficient to ablate through the veins. This was probably the result of a higher tensile strength of the vasculature compared to the mesophyll layer. Although these points of analysis constituted only small percentage of the voxels it is important to consider them separately when interpreting the obtained 3D molecular images. To compensate for differences in water content and tensile strength, an increased number of laser pulses and/or higher incident laser energies can be used.

Three-dimensional molecular imaging of mass-selected ions revealed a variety of distribution patterns for metabolites and indicated the coexistence of diverse metabolic pathways. These patterns could be grouped on the basis of lateral and cross-sectional molecular homogeneity. The first group of metabolites demonstrated homogenous distributions in all three dimensions. For example, the protonated 7-oxocoumarin (m/z 163.0373 measured), sodiated methoxy-hydroxyphenyl glucoside (m/z 325.0919 measured), and acacetin diglucuronide (m/z 637.0127 measured) fell in this category.

Other metabolites were distributed homogeneously within horizontal layers but exhibited pronounced variations in ion signal with depth. The abundance of these metabolites depended on tissue layers. For example, the 3D molecular image of the protonated kaempferol-(diacetyl coumaryl-rhamnoside) with measured and calculated m/z of 663.1731 and 663.1714, respectively, revealed significantly higher ion counts in the mesophyll (third and fourth) layers compared to the epidermal sections. For the ion m/z 377.0842, possibly corresponding to tetrahydroxy-trimethoxyflavone, the center of distribution, however, shifted to the spongy tissues (second and third layers). A handful of ions, including those registered at m/z 501.1259 and 647.1942, also belonged to this group with distribution characteristics between these two cases.

Figure 9:
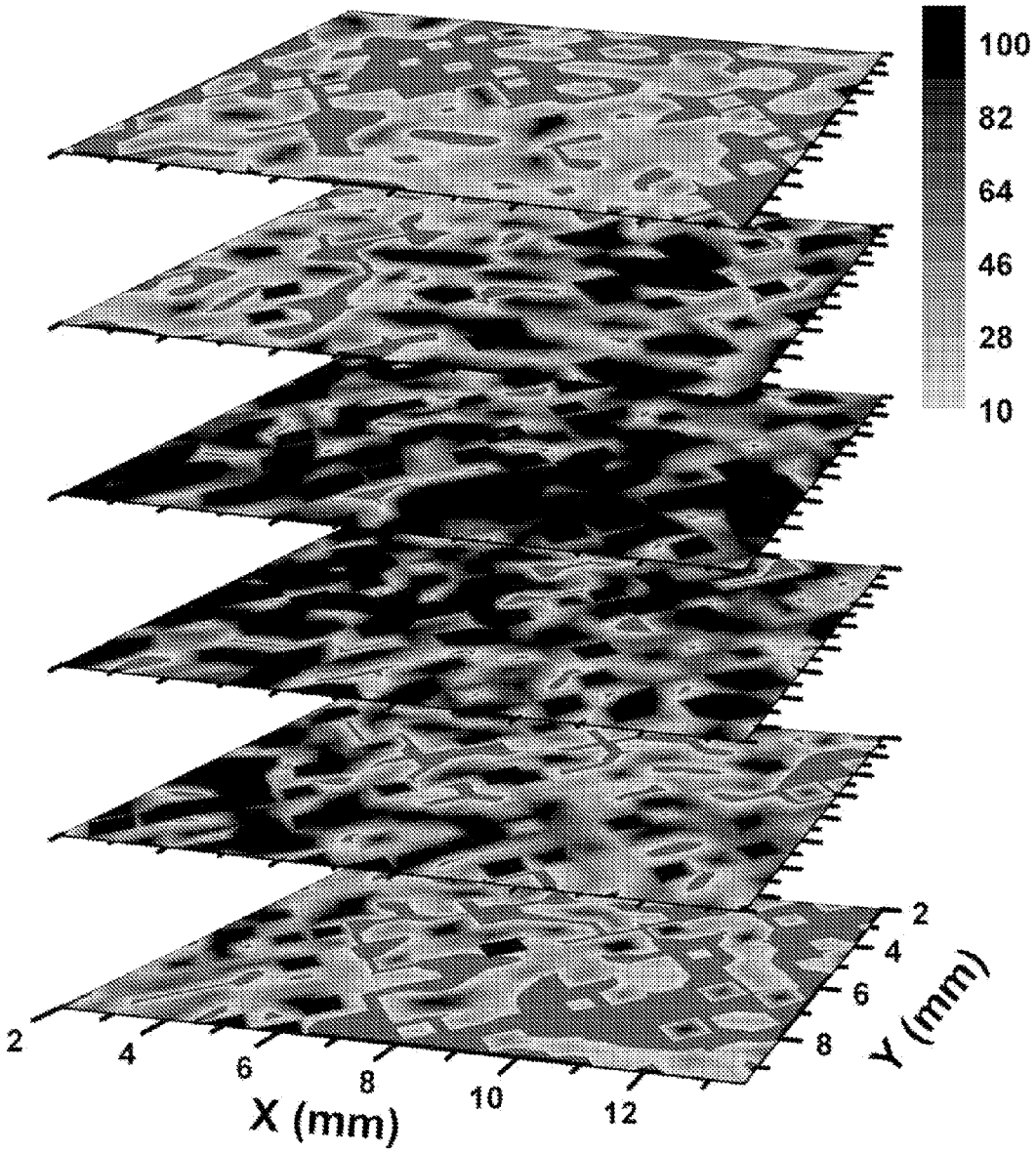
FIG. 9 shows the 3D distribution of kaempferol-(diacetyl coumarylrhamnoside) with m/z 663.1731 as an example for accumulation in the mesophyll (third and fourth) layers with uniform distributions within these layers.

Another class of metabolites exhibited distributions with lateral heterogeneity. Such localization was observed in all the layers for the protonated kaempferol/luteolin and methoxy(kaempferol/luteolin) glucuronide ions with measured m/z values of 287.0494 and 493.0942, respectively. Shown in FIG. 9, both metabolites yielded higher intensities in the second and third layers. Kaempferol/luteolin ions were observed in about 90% of the variegation pattern area, indicating that this metabolite was characteristic to the cells of the achlorophyllous tissue sections. On the other hand, this coverage was only about 40% for the methoxy(kaempferol/luteolin) glucuronide ions, which showed higher intensities along the secondary vein in the top 180 μm layer of the leaf. The optical image of the leaf cross section revealed that the secondary vasculature was located about 150-200 μm below the upper surface and was in direct contact with the cells of the variegation pattern. This correlation between the molecular and the optical images suggested that the glucuronide derivative originated from the secondary veins of the leaf.

Abundance changes both as a function of depth and lateral position proved tissue-specificity for a handful of metabolite ions. In 2D imaging experiments, some of these features were only partially revealed or completely obscured. Because 2D imaging integrates the depth profiles for every lateral position, patterns can only be resolved when variations in signal levels do not cancel out. Variegation with depth can be seen in FIG. 4D for the $[\text{chlorophyll} + H]^+$ ion with m/z 893.5457 that populates the mesophyll layers. Cells in the yellow sectors appeared in white/yellow color under an optical microscope, indicating chlorophyll deficiency. Areas comprised of these exhibited cross-sectional molecular patterns for chlorophyll in 3D that were anti-correlated with that of the variegation pattern; lower chlorophyll intensities were obtained in the yellow sectors. These data allowed us to confirm the achlorophyllous nature of the cells. Similar feature was noticed for the ion with nominal m/z 813, which was in agreement with the results of lateral imaging.

Placing a 3D distribution into one of these four qualitative categories is not always possible. For example the distributions for m/z 317.1 and 639.1 are quite similar and assigning them to particular groups can be subjective. A quantitative characterization of the relationship between tissue architecture and metabolite distributions is possible through the correlation between the intensity distribution of the tissue morphology acquired through, e.g., optical imaging, M(r), and the normalized distribution for the m/z ion obtained by, e.g., LAESI MS, $I_{mi}(r)$. The correlation coefficient, defined as:

$$\rho_{M,I_{mi}} = \frac{\text{cov}(M, I_{mi})}{\alpha_M \alpha_{I_{mi}}}$$

where cov is the covariance of the two variables in the imaged volume and $\tau_m$ and $\tau_{Imi}$ stand for the standard deviations of M and $I_{mi}$, is a measure of the connection between the captured morphological features and the distribution of the particular metabolite. If, for example, the morphology of an organ, M(r), is known from magnetic resonance imaging (MRI) correlation coefficient can reveal the relationship between that organ and a detected metabolite. Likewise, spatial correlations between the intensity distributions of i-th and j-th ions, $\rho_{Imi,Imj}$ can help in identifying the metabolic relationship between chemical species.

Pearson product-moment correlation coefficients, $r_{m1m2}$, were calculated between the 3D spatial distributions of ion intensities, $I_{m/z}(r)$, for twelve selected m/z in an *A. squarrosa* leaf. For obvious cases, e.g., m/z 301 and 317 the $r_{301,317}$=0.88, i.e., the results confirmed the strong correlation between ion distributions placed in the same groups. Furthermore, the degree of similarity was reflected for less clear cases. For example, for m/z 285 and 287 the $r_{285,287}$=0.65, i.e., although both distributions reflect the variegation pattern, in layers two and three the m/z 285 distribution exhibits significant values in the green sectors, as well. Another interesting example was the lack of spatial correlation between kaempferol/luteolin at m/z 287 and chlorophyll a at m/z 893. The low value of the correlation coefficient, $r_{287,893}$=0.08, indicated that these two metabolites were not co-localized. They are also known to belong to different metabolic pathways. This and other examples showed that the correlation coefficients can be a valuable tool to identify the co-localization of metabolites in tissues and to uncover the connections between the metabolic pathways involved.

Several doubly charged ions were observed above m/z 500, including m/z 563.2, 636.2, 941.3, 948.3, 956.3 and 959.3. Tandem mass spectrometry experiments indicated that the related 1.2-1.9 kDa species were not adduct ions. Their 3D distribution pattern correlated with that of the protonated chlorophyll a molecule. Higher abundances were noticed in the chlorophyllous tissue of the palisade and spongy mesophyll region, indicating a possible direct link to the photosynthetic cycle. Structural assignment was not attempted for these ions.

Figure 7:
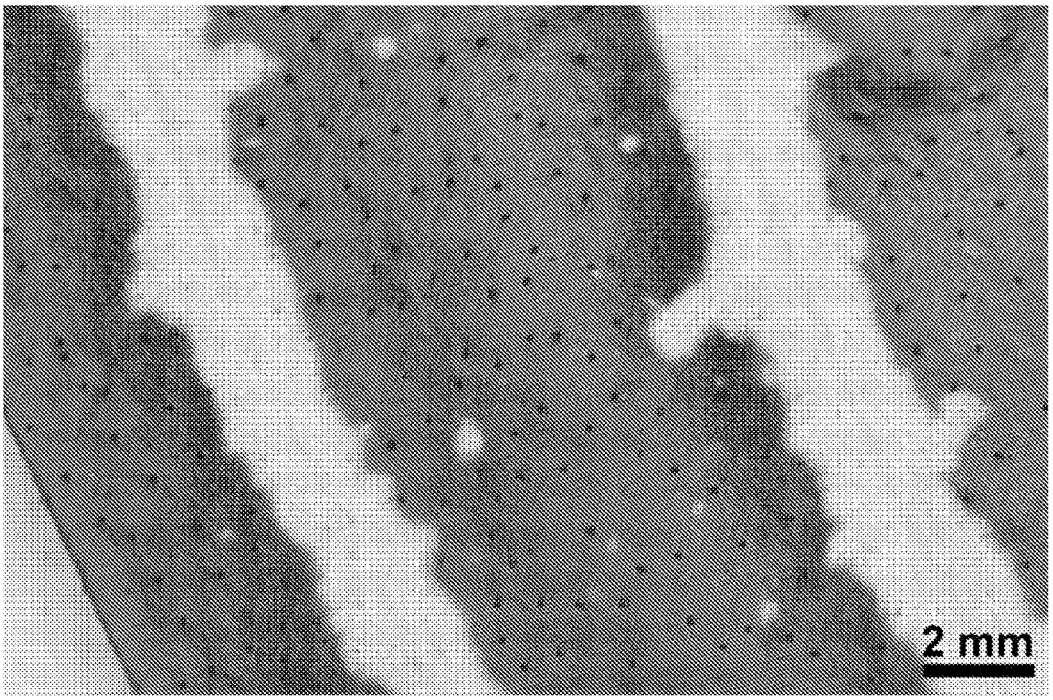
FIG. 7 is an optical image of the variegation pattern on the leaf of *A. Squarrosa*. The metabolite makeup of the rastered area was probed by 3D LAESI IMS.
Figure 10:
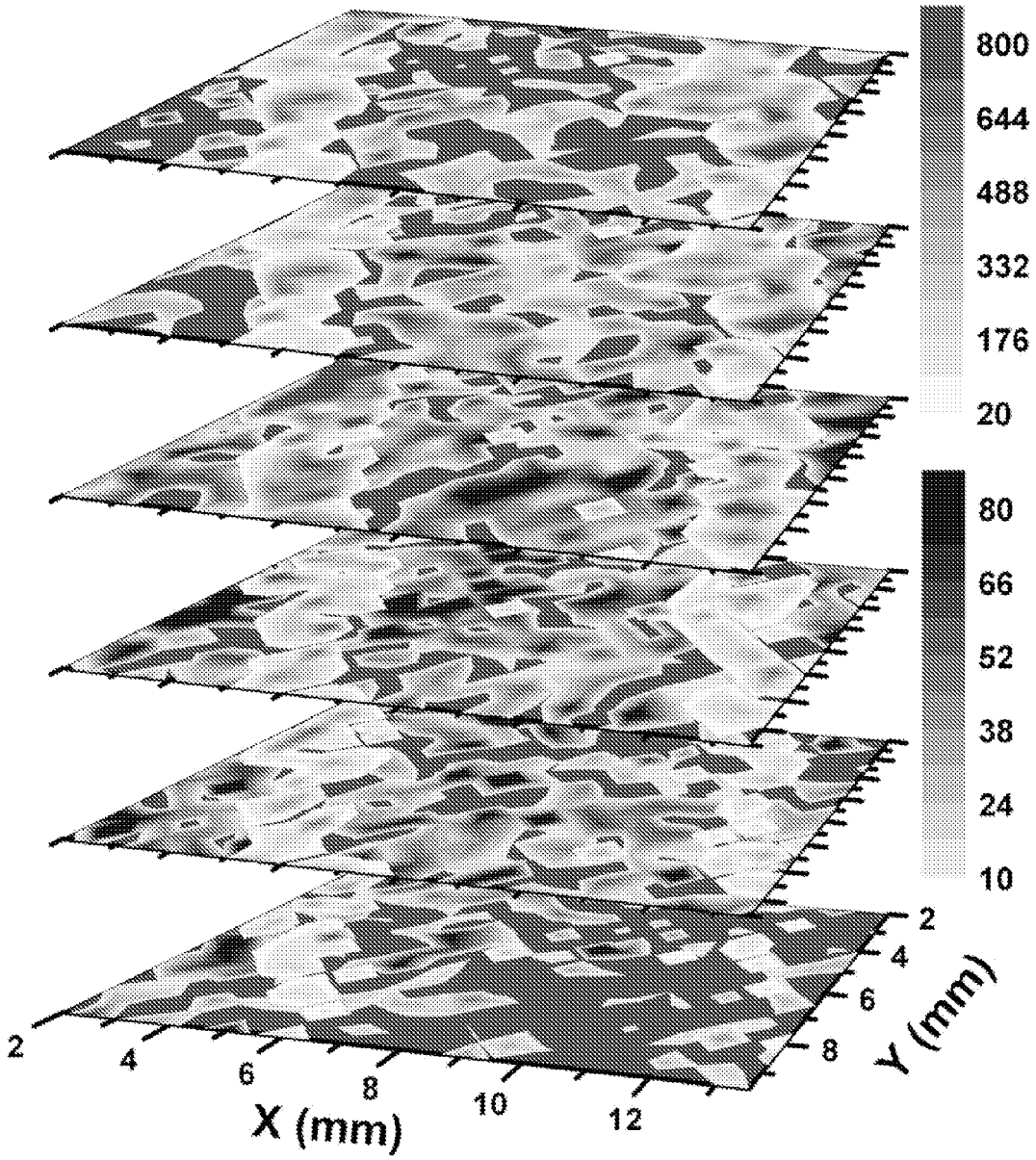
FIG. 10 shows, in cyan-royal color scale, the protonated chlorophyll a ion with m/z 893.5457 in the mesophyll layers. For this ion, however, lower intensities were observed along the variegation pattern, in agreement with the achlorophyllous nature of the yellow sectors. Kaempferol/luteolin with m/z 287.0494 exhibited heterogeneity both laterally and in the cross section, and was most abundant in the second and third layers.
Figure 11:
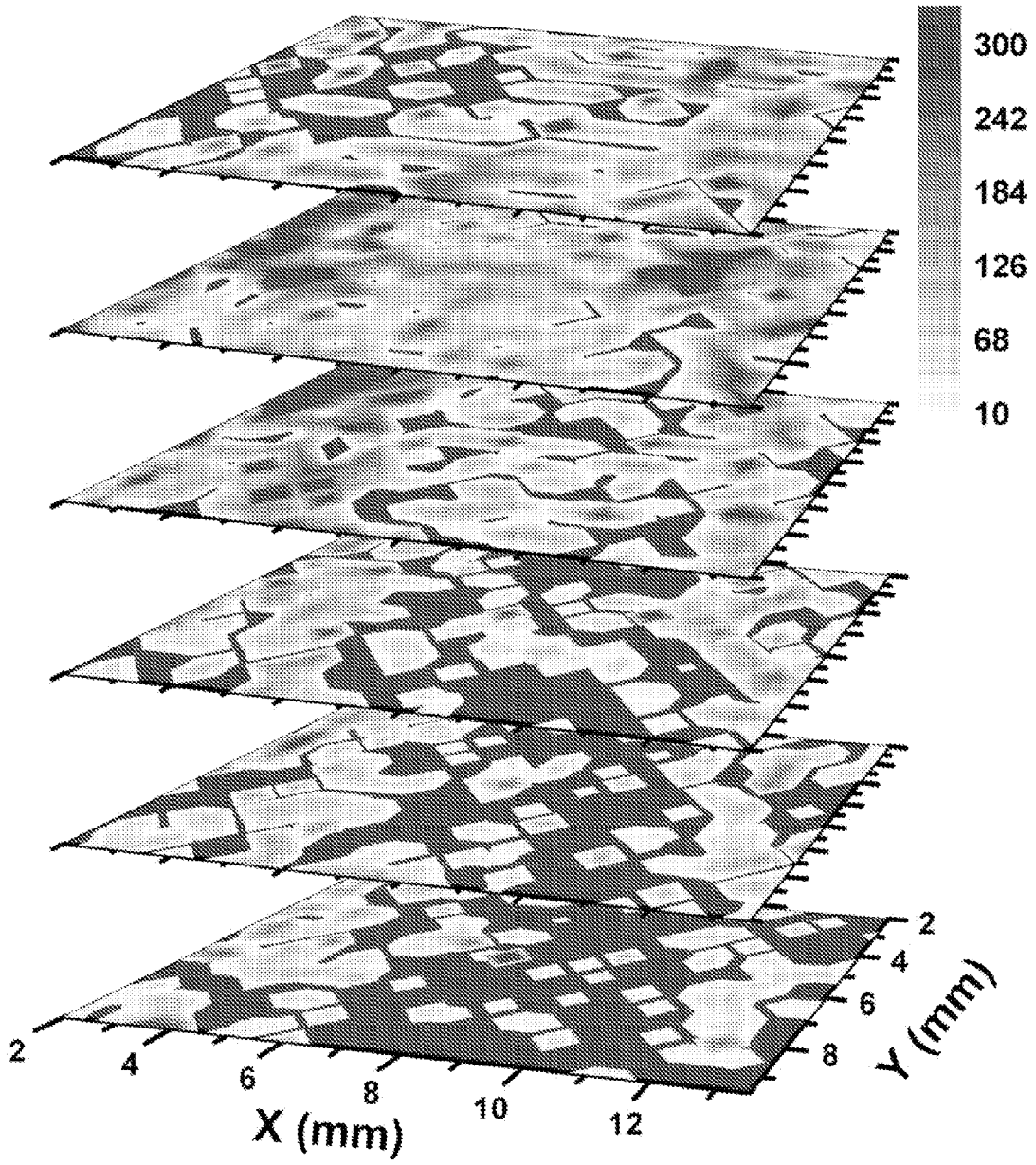
FIG. 11 shows that Acacetin with m/z 285.0759 belonged to a group of compounds with tissue-specificity not previously revealed in lateral imaging experiments due to the averaging of depth distributions. Its molecular distribution was uniform in the first, fourth, fifth and sixth layers, but resembled the variegation pattern (compare to FIG. 8) in the second and third layers.
Figure 12:
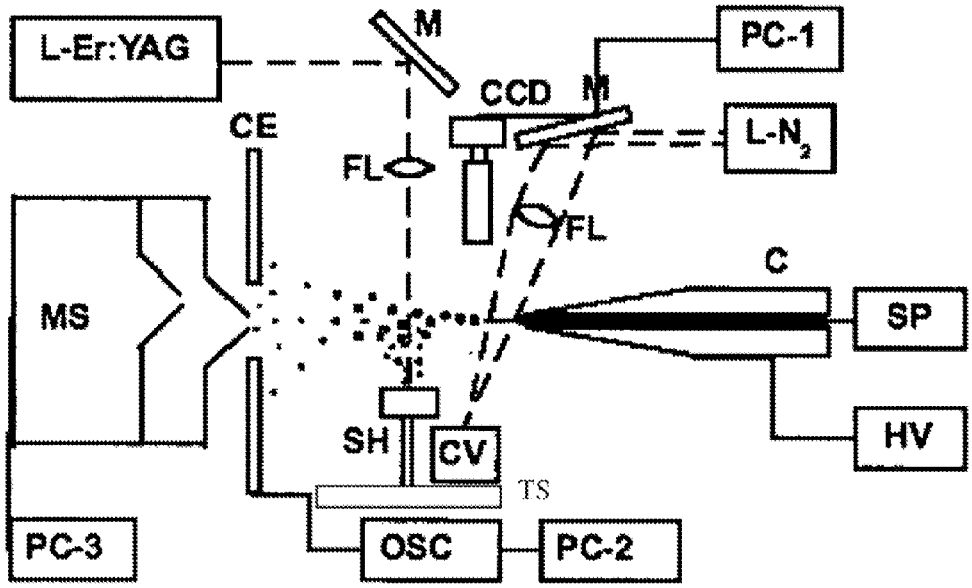
FIG. 12 illustrates a LAESI-MS device for three-dimensional imaging according to certain embodiments. The LAESI-MS device may comprise a capillary (C); a syringe pump (SP); a HV high-voltage power supply; a L-N2 nitrogen laser; mirrors (M); focusing lenses (FL); a cuvette (CV); a CCD camera with short-distance microscope (CCD); a counter electrode (CE); digital oscilloscope (OSC); a sample holder (SH); a translation stage (TS); a Er:YAG laser (L-Er:YAG); a mass spectrometer (MS); and personal computers (PC-1 to PC-3).

The combination of lateral imaging with depth profiling proved important in cases when ion intensities integrated over the section gave no total variance. For example, acacetin and methylated kaempferol/luteolin have been described in the chlorophyllous tissues and also in those that partially comprised sections of the variegation, revealing no significant accumulation through the cross-sections. The 3D localization of the former ion with m/z 285.0759 uncovered information that had been hidden in our 2D LAESI IMS experiments. Its molecular distribution was rather uniform across the first, fourth, fifth and six layers of analysis (see FIG. 10). The second and third laser shots, however, exhibited lateral heterogeneity in the molecular distribution. The X-Y coordinates of pixels with higher intensities (see intensities above about 200 counts in red color) coincided with the position of the secondary vasculatures captured in FIGS. 7 and 8. The secondary metabolites kaempferol/luteolin diglucuronide and luteolin methyl ether glucoronosyl glucuronide observed at m/z 639.1241 and 653.1358 exhibited similar distributions in space. These data indicated that the route of synthesis and/or transport for these metabolites differed from the ones in the other groups mentioned above.

We have shown that LAESI is an ambient ionization source for MS that enables the simultaneous investigation of a variety of biomolecules while eliminating the need for tailored reporter molecules that are generally required in classical biomedical imaging techniques. In vivo analysis with low limits of detection, a capability for quantitation, and lateral and depth profiling on the molecular scale are further virtues of this method with great potential in the life sciences. The distribution of secondary metabolites presented in this work, for example, may be used to pinpoint the tissue specificity of enzymes in plants. Water-containing organs, tissue sections or cells from plants or animals, as well as medical samples can be subjected to 3D analysis for the first time. The studies can be conducted under native conditions with a panoramic view of metabolite distributions captured by MS.

B. CONCLUSIONS

LAESI is an ambient ionization source that enables the simultaneous investigation of a variety of biomolecules while eliminating the need for tailored reporter molecules that are generally required in classical biomedical imaging techniques. In vivo analysis with low limits of detection, a capability for quantitation, and lateral and depth profiling on the molecular scale are further virtues of the method that forecast great potentials in the life sciences. The distribution of secondary metabolites presented in this work, for example, may be used to pinpoint enzymes to tissue or cell specificity in plants. Water-containing organs or whole-body sections of plants, animals and human tissues or cells can be subjected to 3D analysis for the first time under native conditions with a panoramic view for ions offered by MS.

Although three-dimensional ambient imaging with LAESI has proved feasibility in proof of principle experiments as well as in real-life applications, further developments are needed on the fundamental level. For example, variations in the water content and tensile strength of tissues can affect the lateral imaging and depth profiling performance of the method. An automated feed-back mechanism may correct for these effects by continuously adjusting the laser energy and/or wavelength while recording the depth of ablation for each laser pulse. With typical resolutions of about 300-350 μm and 50-100 μm in the horizontal and vertical directions, LAESI offers middle to low level of resolving power in comparison to optical imaging techniques. Advances are promised by oversampling typically applied in MALDI experiments, aspherical lenses for light focusing, and fiber optics for direct light coupling into the sample. The latter two approaches have allowed us to analyze single cells with dimensions of about 50 μm diameter while maintaining good signal/noise ratios. Higher lateral and depth resolutions in three dimensions can dramatically enhance our understanding of the spatial organization of tissues and cells on the molecular level.

C. METHODS AND MATERIALS

1. Laser Ablation Electrospray Ionization

The electrospray source was identical to the one we have recently described. A low-noise syringe pump (Physio 22, Harvard Apparatus, Holliston, Mass.) supplied 50% methanol solution containing 0.1% (v/v) acetic through a tapered tip metal emitter (100 μm i.d. and 320 μm o.d., New Objective, Woburn, Mass.). Electrospray was initiated by directly applying stable high voltage through a regulated power supply (PS350, Stanford Research System, Inc., Sunnyvale, Calif.). The flow rate and the spray voltage were adjusted to establish the cone-jet mode. This axial spraying mode has been reported to be the most efficient for ion production.

Live leaf tissues of approximately 20×20 $mm^2$ area were mounted on microscope slides, positioned 18 mm below the electrospray axis. The output of a Nd:YAG laser operated at a 0.2-Hz repetition rate (4-ns pulse duration) was converted to 2940 nm light via an optical parametric oscillator (Vibrant IR, Opotek Inc., Carlsbad, Calif.). This mid-infrared laser beam was focused with a plano-convex focusing lens (50 mm focal length) and was used to ablate samples at right angle under 0° incidence angle, about 3-5 mm downstream from the tip of the spray emitter. During the *Spathiphyllum Lynise* (about 200 μm average thickness) and *Aphelandra Squarrosa* (about 450

μm average thickness) imaging experiments, the average output energy of a laser pulse was measured to be 0.1 mJ±15% and 1.2 mJ±10%, respectively.

Scanning electron microscopy (JEOL JSM-840A, Peabody, Mass.) of the ablation craters indicated that, as a single laser pulse impinged on the adaxial surface of the leaf, the epidermal cells were removed in an elliptical area with 320 μm and 250 μm major and minor axes, respectively. Using optical microscopy, exposure with consecutive laser shots was found to result in slightly elliptical areas with axes of about 350 μm and about 300 μm for *S. Lynise* and 350 μm diameter circular ablation marks for *A. Squarrosa*, which translated into a fluence of about 0.1 J/cm$^2$ and about 1.2 J/cm$^2$ at the focal point, respectively.

The ablated material was intercepted by the electrospray plume and the resulted ions were analyzed by an orthogonal acceleration time-of-flight mass spectrometer (Q-TOF Premier, Waters Co., Milford, Mass.) with a 1 s/spectrum integration time. The original electrospray ion source of the mass spectrometer was removed. The sampling cone of the mass spectrometer was located on axis with and 13 mm away from the tip of the spray emitter. The ion optics settings of the instrument were optimized for best performance and were kept constant during the experiments. Metabolite identification was facilitated by tandem MS. Fragmentation was induced by CAD in argon collision gas at $4\times10^{-3}$ mbar pressure with the collision energy set between 15-30 eV.

2. Three-Dimensional Molecular Imaging with LAESI

A three-axis translation stage was positioned with precision motorized actuators (LTA-HS, Newport corp., Irvine, Calif.) to scan the sample surface while keeping all other components of the LAESI setup in place. The actuators had a travel range of 50 mm and a minimum incremental motion of 0.1 μm. Thus, the ultimate resolution was determined by the focusing of the incident laser beam and the dimensions of the ablation craters (about 350 μm in diameter). To avoid the overlapping of the probed areas, the sample surface was scanned at a step size of 500 μm in the X and Y directions. At each coordinate, the cross-section of the live tissues were analyzed with 6 laser pulses while the generated ions were recorded for 30 seconds with the mass spectrometer. Under these settings, three-dimensional imaging of a 12.5×10.5 mm$^2$ area required a total analysis time of about 5 hours. Higher repetition rates for laser ablation and a lowered ion collection time can significantly shorten this analysis time in future applications. A software was written in-house (LabView 8.0) to position the translation stage and render the analysis times to the corresponding X-Y coordinates and laser pulses. The exported data sets of mass-selected ions were converted into three dimensional distributions and were presented in contour plot images with a scientific visualization package (Origin 7.0, OriginLab Co., Northampton, Mass.).

3. Chemicals

Glacial acetic acid (TraceSelect grade) and gradient grade water and methanol were obtained from Sigma Aldrich and were used as received. The Easter lily (*Spathiphyllum Lynise*) and Zebra plant (*Aphelandra Squarrosa*) were purchased from a local florist at an approximate age of one and a half years. The plants were watered every 2 days with about 300 mL tap water to keep their soil moderately moist to touch. No fertilizer was used during the experiments. Temperature and light conditions were 20-25° C. in light shade, protected from direct sun.

It will be clear to a person of ordinary skill in the art that the above embodiments may be altered or that insubstantial changes may be made without departing from the scope of the invention. Accordingly, the scope of the invention is determined by the scope of the following claims and their equitable equivalents.

What is claimed is:

1. A laser ablation electrospray ionization mass spectrometry device for three-dimensional imaging of a sample having a water content, the device comprising:

a pulsed, mid-infrared laser to emit energy at the sample to ablate the sample and generate an ablation plume;

an electrospray apparatus to produce an electrospray to intercept the ablation plume to produce ions;

a mass spectrometer having an ion transfer inlet to capture the produced ions; and a scanning apparatus to generate a three-dimensional image of the sample;

wherein each laser pulse has a laser energy that is absorbed by the water in the sample.

2. The device of claim 1, wherein the laser pulse has a wavelength of about 3 μm.

3. The device of claim 1, wherein the laser pulse has a pulse length less than 100 nanoseconds.

4. The device of claim 1, wherein the sample is one of a solid, an aqueous solution, a wetted surface, and a reconstituted sample.

5. The device of claim 1 comprising a reactant in at least one of a gas phase, the sample, the electrospray, and combinations thereof.

6. The device of claim 1, wherein the electrospray comprises an alcohol, an acid, an internal standard, and combinations thereof.

7. The device of claim 1, wherein the sample is at ambient conditions.

8. The device of claim 1, wherein the sample is not at ambient conditions, with the proviso that the sample is not at vacuum.

9. The device of claim 1, wherein the sample is at one of an elevated pressure, an elevated temperature, and a combination thereof.

10. The device of claim 1, wherein the scanning apparatus is programmed for one of lateral scanning of the sample, depth profiling of the sample, and a combination thereof.

11. The device of claim 1, wherein the scanning apparatus comprises a three-axis translation stage.

12. The device of claim 1 comprising a camera to measure a size and a depth of the ablation in the sample by the laser pulse, and a feedback mechanism to continuously adjust one of the laser pulse, the laser energy, a wavelength, a working distance, and combinations thereof.

13. A method of laser ablation electrospray ionization mass spectrometry for three-dimensional imaging of a sample having a water content, the method comprising:

ablating the sample with a mid-infrared laser pulse at a wavelength of about 3 μm to generate an ablation plume;

intercepting the ablation plume with an electrospray to produce ions; and analyzing the ions by a mass spectrometer comprising a scanning apparatus to generate a three-dimensional image of the sample;

wherein each laser pulse has a laser energy that is absorbed by the water in the sample.

14. The method of claim 13, wherein the sample comprises a target, and the method is characterized by negligible photochemical damage to the target by the laser energy.

15. The method of claim 13 comprising one of lateral scanning of the sample, depth profiling of the sample, and a combination thereof.

16. The method of claim 13 comprising adding an aqueous solution to the sample.

17. The method of claim 13 comprising ablating the sample in the presence of a reactant in one of a gas phase, the sample, the electrospray, and combinations thereof.

18. The method of claim 13 comprising measuring a size and a depth of the ablation in the sample by the laser pulse, and adjusting a feedback mechanism to continuously adjust one of the laser pulse, the laser energy, the wavelength, a working distance, and combinations thereof.

19. The method of claim 13 comprising generating a spatial distribution image of a first ion.

20. The method of claim 13 comprising generating a co-localization image of a first ion and a second ion.

* * * * *